US006474583B1

(12) United States Patent
Won

(10) Patent No.: US 6,474,583 B1
(45) Date of Patent: Nov. 5, 2002

(54) ROTARY LOOPER

(75) Inventor: Woong-Jae Won, Inchon (KR)

(73) Assignee: Wonjin Industrial Co., Ltd., Inchon (KR)

( * ) Notice: Subject to any disclaimer, the term of this patent is extended or adjusted under 35 U.S.C. 154(b) by 0 days.

(21) Appl. No.: 09/700,891

(22) PCT Filed: Mar. 30, 2000

(86) PCT No.: PCT/KR00/00285

§ 371 (c)(1),
(2), (4) Date: Nov. 20, 2000

(87) PCT Pub. No.: WO00/61312

PCT Pub. Date: Oct. 19, 2000

(30) Foreign Application Priority Data

Apr. 13, 1999 (KR) ..... 99-13064

(51) Int. Cl.[7] ..... B65H 51/20
(52) U.S. Cl. ..... 242/364.1
(58) Field of Search ..... 242/364.1, 362, 242/363, 364.2, 364.3, 364.11, 364.12, 412, 412.1, 412.2, 417, 552, 558, 559, 559.4, 559.1

(56) References Cited

U.S. PATENT DOCUMENTS 3,888,430 A * 6/1975 Costello et al. ..... 242/55
4,441,661 A * 4/1984 Steinmair ..... 242/55
4,569,487 A * 2/1986 Sluzallek ..... 242/55
5,443,221 A * 8/1995 Petry ..... 242/364.1
5,529,257 A * 6/1996 Abbey, III et al. ..... 242/364.1
5,575,434 A * 11/1996 Steinmair ..... 242/364.1
5,720,444 A * 2/1998 Wheeler et al. ..... 242/364.1

* cited by examiner

*Primary Examiner*—Donald P. Walsh
*Assistant Examiner*—Mark J Beauchaine
(74) *Attorney, Agent, or Firm*—Harrison & Egbert

(57) ABSTRACT

A rotary looper including a base member, a fixed drum installed on the base member and having spiral guide rollers, a pair of pinch rollers and series of lead rollers sequentially disposed at an inputting side of the base member, and a pair of measuring rollers disposed at a discharging side of the base member. The present invention also includes inside basket rollers, a rotary drum disposed around the fixed drum in a manner such that the rotary drum is rotatably driven by a motor via a rail which is wound around rail rollers which are circularly installed on the base member, a lead drum rotatably disposed in a portion of the rotary drum, inside basket guide rollers, outside basket rollers, and outside basket guide rollers spaced apart from the outside basket rollers by a predetermined distance.

1 Claim, 5 Drawing Sheets

ROTARY LOOPER

BACKGROUND OF THE INVENTION

1. Field of the Invention

The present invention relates to a continuous pipe producing line, and more particularly, the present invention relates to a rotary looper, which preliminarily stores convolutions of a coil type strip (hereinafter, referred to as "strip") uncoiled by an uncoiler toward a pipe mill, thereby enabling a newly supplied coil of strip to be continuously supplied to the pipe mill.

2. Description of Related Art

Conventionally, in a pipe producing line, a strip is uncoiled by an uncoiler and continuously fed into a pipe mill to produce a completed pipe. Due to the fact that there is an imposed limit, such as a predetermined amount of a strip, that can be continuously fed into the pipe mill, it takes 10 to 20 minutes at best for a unit coil of strip to be fully depleted and a new unit coil of a strip to be supplied into the pipe mill after the depletion. In this roll supply process, an operation of the pipe mill must be interrupted whereby a great deal of effort and time are required.

Therefore, as an alternative for enabling a strip to be continuously fed into a pipe mill without interrupting an operation of the pipe mill, it is regarded as the best method to weld a leading edge of a newly supplied unit coil of strip to a trailing edge of a currently depleted unit coil of strip.

However, since the pipe mill always takes out a strip at a constant rate and the strip has a moving speed corresponding to the take-out rate of the pipe mill, it is impossible, in actual fact, to butt and weld the leading edge of the newly supplied unit coil of strip and the trailing edge of the currently depleted unit coil of strip to each other, while the trailing edge of the currently depleted unit coil of strip is fed into the pipe mill.

To cope with this problem, a vertical type looper is disclosed in the art by Kent Corporation of the United States. In the vertical type looper, the strip is taken out by a separate device where it is to be preliminarily stored on the looper, at the time when a trailing edge of a unit coil of strip is nearly exposed to the outside at a rate which is faster than a normal feed rate of the strip. While the preliminarily stored convolutions of the strip are paid out to a pipe mill to be used in continuous pipe producing, the input of the strip to the looper is stopped for connecting, as by welding, a leading edge of a newly supplied unit coil of strip to the current unit coil of strip. A splicing station is provided between an uncoiler and the looper for making such a connection possible.

Such a conventional vertical type looper is, as shown in FIG. 1, installed on a base member 10 which is arranged between an uncoiler A and a pipe mill B. A pair of input pinch rollers 1 take out a strip 8 which is uncoiled by the uncoiler A, and an input guide 2 guides the strip 8 which is taken out by the pair of input pinch rollers 1. A guide plate 3 is disposed adjacent to a downstream end of the input guide 2. The strip 8, which is taken out by the pair of input pinch rollers 1, passes through the input guide 2 and the guide plate 3. Then, the strip 8 travels inside a plurality of outside basket guide rollers 7, by at least one turn in a state wherein it is brought into close contact with inside surfaces of the outside basket guide rollers 7. Thereupon, the strip 8 forms a U-shaped free loop 8' as it is turned toward a plurality of inside basket guide rollers 6. The strip 8 also travels outside the plurality of inside basket guide rollers 6 by at least one turn. Thereafter, the strip 8 is transferred around a series of spiral guide rollers 5. After traveling along the series of spiral guide rollers 5, the strip 8 is fed into the pipe mill B while being pulled by a pair of measuring rollers 4.

In this course of transferring the strip 8, by driving the pair of input pinch rollers 1 and thereby taking out the strip 8 into the looper at a speed generally faster than that of the strip 8 out of the looper into the pipe mill B, as the U-shaped free loop 8' orbits in a traveling direction of the strip 8 around a plurality of outside basket guide rollers 7, outer convolutions and inner convolutions are accumulated or stored on the inside surfaces of the outside basket guide rollers 7 and outside surfaces of the inside basket guide rollers 6, respectively, by the same number. At this time, the strip 8 is brought into close contact with the inside surfaces of the outside basket guide rollers 7 tightly, due to its spring back phenomenon. And as a result of tight frictional contact between the rollers 7 and the strip 8, it is difficult for the strip 8 to further travel around a plurality of outside basket guide rollers 7, when at least one convolution is stored on the inside surfaces of the outside basket guide rollers 7. Consequently, the strip 8 is to be jammed in the input guide 2 or the guide plate 3, or it may be impossible to further take out the strip 8 using the pair of input pinch rollers 1. By reason of this, as the number of outer convolutions of the strip 8 increases, a diameter of a circular space which is defined by the plurality of outside basket guide rollers 7 should also be gradually increased as shown in FIG. 1 by dotted lines, thereby to enable the strip 8 to be stored while being inserted into a gap which is continuously maintained between the outermost convolution and the inside surfaces of the outside basket guide rollers 7. Also, due to the fact that the plurality of outside basket guide rollers 7 are moved outward as described above, as a distance between the innermost outer convolution and the outermost inner convolution varies rather than being constantly kept, the U-shaped free loop 8' can be bent rather than being flexibly curved. Hence, a diameter of a circular space which is defined by the inside basket guide rollers 6 should also be gradually increased as shown in FIG. 1 by dotted lines, thereby to enable the strip 8 to be tensely stored on the outside surfaces of the inside basket guide rollers 6.

On the other hand, an inside configuration for accomplishing the adjustment of diameters of circular spaces which are defined by the spiral guide rollers 5, the inside basket guide rollers 6 and the outside basket guide rollers 7, respectively, is as complex as the numbers of the spiral guide rollers 5, the inside basket guide rollers 6 and the outside basket guide rollers 7, as schematically shown in FIG. 2, and comprises a multitude of links L, each of which is driven by a hydraulic system or a pneumatic system. Thus, because fabricating and assembling procedures of a variety of components constituting the looper are greatly complicated and difficult to implement, fabricating cost is increased, a failure rate is elevated and noise is generated.

If an initial width between the innermost outer convolution and the outermost inner convolution is set large, such that the strip 8 has a small thickness, as an arc which is defined by the U-shaped free loop 8' as increased in its length, the strip 8 is likely to be bent rather than smoothly orbiting around the inside basket guide rollers 6 and the outside basket guide rollers 7. Therefore, in the case of the strip 8 having a small thickness, cumbersomeness is caused by the fact that initial positions of the plurality of outside basket guide rollers 7 must be adjusted thereby to shorten the initial width between the innermost outer convolution and the outermost inner convolution.

Moreover, because the strip 8 which is taken out by the pair of input pinch rollers 1 must be always transferred to the looper in a direction which is tangential to an upper end surface of the lowermost outside basket guide roller 7, the pair of input pinch rollers 1, the input guide 2 and the guide plate 3 are structured in a manner such that they can be simultaneously lowered by the link arrangements as the plurality of outside basket guide rollers 7 are moved outward, whereby complexity of the entire looper is augmented, fabricating cost is increased and failure frequently occurs.

In addition, while the looper is operated, the convolutions of the strip 8 always travel around a circular path in a state wherein they are brought into close contact one with another, frictional force is generated between two adjoining convolutions of the strip 8 due to elasticity of the strip 8. Accordingly, power which is derived by the pair of input pinch rollers 1, must be fairly large to enable the strip 8 to travel around the outside basket guide rollers 7 and the inside basket guide rollers 6, and thereby, frictional noise and dust generation by the strip 8 are increased.

In the meanwhile, in the conventional vertical type looper constructed as mentioned above, since an output position of the strip 8 where it is outputted to the pipe mill B is deviated by a distance of W from an input position of the strip 8 where it is inputted to the looper, in the case that the vertical type looper is installed at a superannuated factory which uses another strip accumulator or strip storing device such as a hoop cage or the like, an installation must be executed in a manner such that a center of the output position of the strip 8 is first aligned with a center of the pipe mill B and then, a center of the uncoiler A is moved from the center of the output position of the strip 8 by the deviation amount of W.

Specifically, the conventional vertical type looper encounters a problem from the standpoint of its construction in that at least one convolution should always be accumulated on the outside basket guide rollers 7 or the inside basket guide rollers 6. If at least one convolution is not accumulated on the basket guide rollers 7 or 6 while the pipe mill B is being continuously operated, it causes serious problems with the operation.

Consequently, in the vertical type looper, if the number of convolutions is no greater than 2, the strip 8 on the basket guide rollers 7 and/or 6 needs to be accumulated sufficiently. The strip accumulating operation must be repeatedly performed whenever the number of the convolutions is decreased to a number no greater than 2, as the convolutions are paid out into the pipe mill B. Then, it may be impossible to secure enough time to weld a leading edge of a newly supplied unit coil of strip 8 to a trailing edge of a current unit coil of strip 8, if a coiled amount of the strip 8 is small and a sufficient amount of the strip 8 cannot be accumulated on the rollers 7 and/or 6. Thereby, it is impossible to keep the continuous operation of the pipe mill B.

Hence, a higher grade of skillfulness is required and an operator should pay close attention to the operation of the vertical type looper, since a size of the strip must be precisely managed with the conventional vertical type looper. Furthermore, the conventional vertical type looper is proved costly to be used in a small-scale pipe producing line and it is difficult to secure a skilled operator. So, the vertical type looper is mainly used in a large-scale pipe producing line presently.

BRIEF SUMMARY OF THE INVENTION

The present invention has been made in an effort to solve the problems occurring in the related art. The object of the present invention is to provide a rotary looper which allows convolutions of a strip to be preliminarily stored by a rotary drum and a lead drum while not being damaged at all. This invention, therefore, minimizes a defective fraction, simplifies respective operating arrangements, and thereby outstandingly reduces manufacturing cost and failure rate. Furthermore, it enables an entering position of the strip and a discharging position of the strip to be aligned with each other on a straight line, thereby to be capable of being suited to an existing pipe producing line as it is.

In order to achieve the above object, according to the present invention, there is provided a rotary looper comprising: a base member; a fixed drum installed on the base member and having a plurality of spiral guide rollers; a pair of pinch rollers and a series of lead rollers sequentially disposed at an inputting side of the base member; a pair of measuring rollers disposed at a discharging side of the base member; a plurality of inside basket rollers circularly installed along a circumferential outer surface of the fixed drum; a rotary drum disposed around the fixed drum in a manner such that the rotary drum is rotatably driven by a motor via a rail which is wound around a plurality of rail rollers which are circularly installed on the base member; a lead drum rotatably disposed in a portion of the rotary drum; a plurality of inside basket guide rollers circularly installed along a circumferential inner surface of the rotary drum; a plurality of outside basket rollers circularly installed along a circumferential outer surface of the rotary drum; and a plurality of outside basket guide rollers circularly installed on the base member outward of the plurality of outside basket rollers in a manner such that they are spaced apart from the plurality of outside basket rollers by a predetermined distance.

BRIEF DESCRIPTION OF THE SEVERAL VIEWS OF THE DRAWINGS

The above objects, and other features and advantages of the present invention will become more apparent after a reading of the following detailed description when taken in conjunction with the drawings:

FIGS. 3*a* and 3*b* are front sectional views illustrating operating states of a rotary looper in accordance with an embodiment of the present invention, wherein FIG. 3*a* illustrates an initial state and FIG. 3*b* illustrates a preliminary accumulating state.

DETAILED DESCRIPTION OF THE INVENTION

Figure 1:
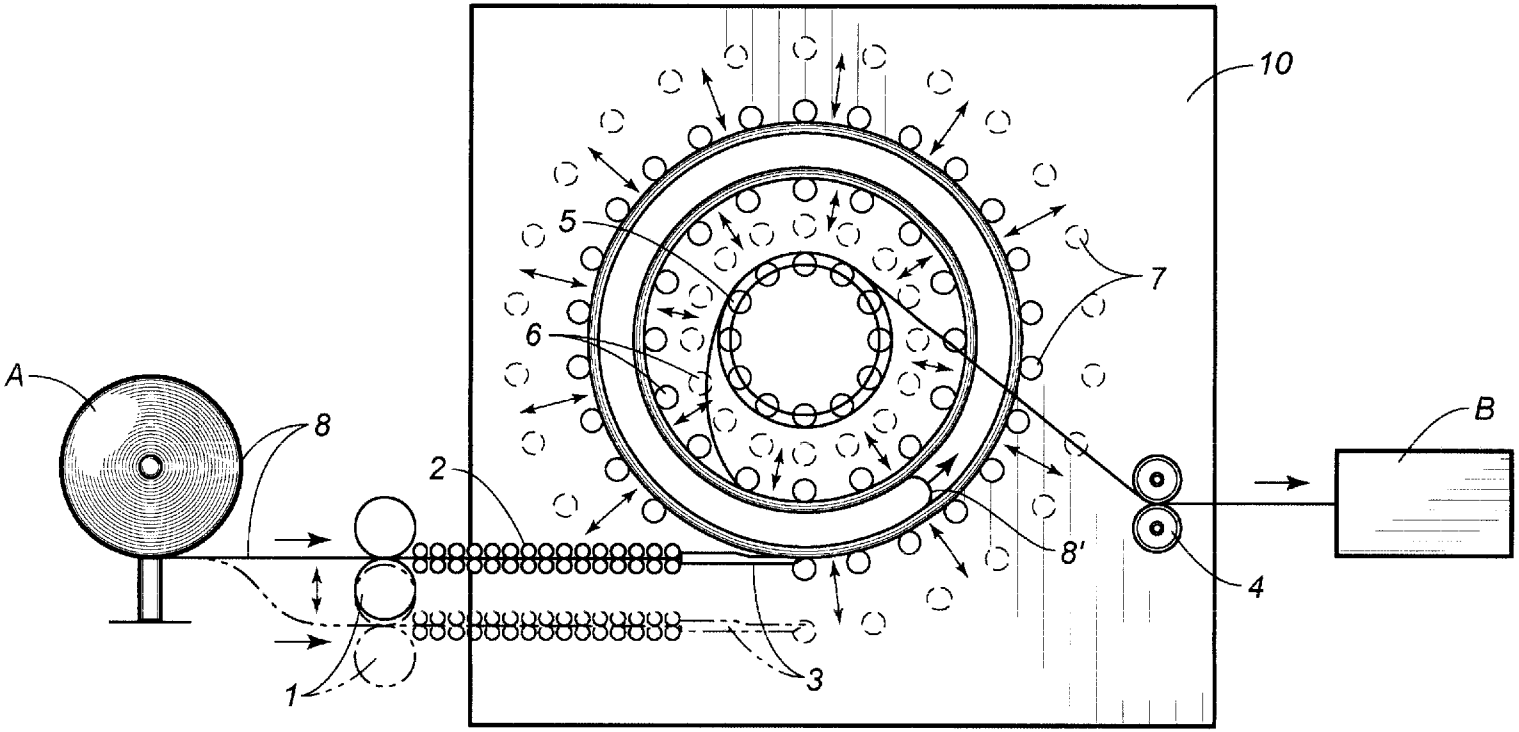
FIG. 1 Prior Art
FIG. 1 is a front sectional view illustrating an operating state of a conventional vertical type looper.
Figure 2:
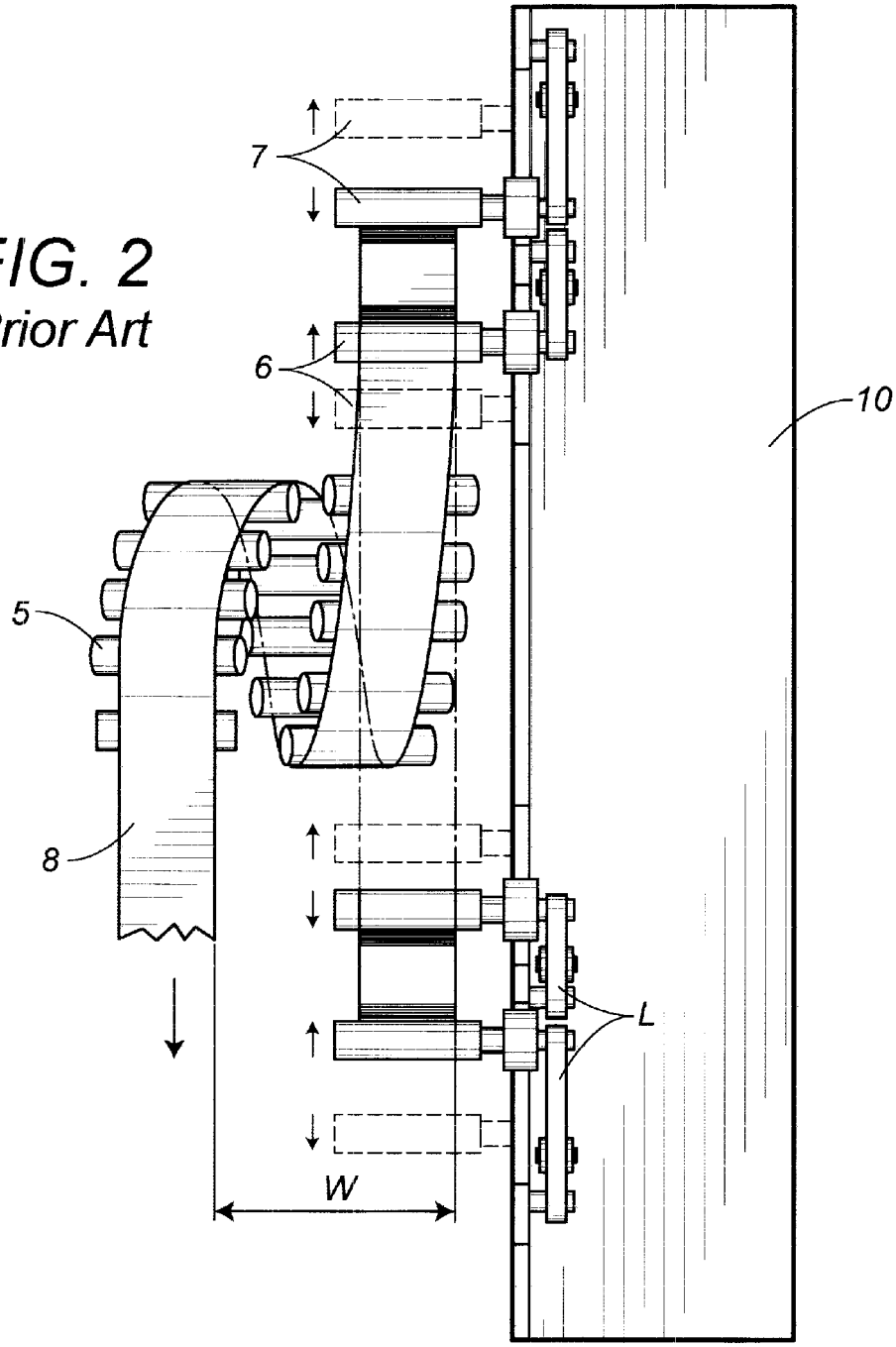
FIG. 2 Prior Art
FIG. 2 is a schematic partial longitudinal cross-sectional view of the vertical type looper of FIG. 1.

Reference will now be made in greater detail to a preferred embodiment of the invention, an example of which is illustrated in the accompanying drawings. Wherever possible, the same reference numerals will be used throughout the drawings and the description to refer to the same or like parts.

A fixed drum 15 is disposed on a center portion of a base member 10 which is slantingly arranged with a predetermined slope $\angle\theta°$ with respect to the ground. A plurality of inside basket rollers 17 is installed along a circumferential outer surface of the fixed drum 15. A plurality of spiral guide rollers 16 are installed inward of the fixed drum 15. The plurality of spiral guide rollers 16 are spirally arranged in a manner such that they project in a direction which is perpendicular to a plane of the base member 10.

A rotary drum 18 is disposed around the fixed drum 15. The rotary drum 18 is rotatably driven by a motor 22 through a rail 20, which is wound around a plurality of rail rollers 21 which are circularly installed on the base member 10. A lead drum 19 is rotatably disposed in a portion of the rotary drum 18.

A plurality of inside basket guide rollers 23 are circularly installed along a circumferential inner surface of the rotary drum 18, and a plurality of outside basket rollers 24 are circularly installed along a circumferential outer surface of the rotary drum 18. A plurality of outside basket guide rollers 25 are circularly installed on the base member 10 outward of the plurality of outside basket rollers 24 in a manner such that they are spaced apart from the plurality of outside basket rollers 24 by a predetermined distance.

A pair of pinch rollers 11 and a series of lead rollers 12 are installed on the base member 10 and adjacent to a lower end of the base member 10 in a manner such that the pinch rollers 11 and the lead rollers 12 are positioned outward of the plurality of outside basket guide rollers 25, and a pair of measuring rollers 14 are arranged outside the base member 10 in a manner such that they are substantially in line with the pair of pinch rollers 11, respectively.

The drawing reference numeral 16' represents a final roller of the plurality of spiral guide rollers 16, and the drawing reference numeral 13 represents a guide roller for guiding a strip 8 to the pair of measuring rollers 14.

In the rotary looper according to the present invention constructed as mentioned above, as shown in FIG. 3*a,* the unit coil of strip 8 is mounted on an uncoiler A. After passing through the pair of pinch rollers 11 and the series of lead rollers 12, the strip 8 enters into an annular space which is defined between the outside basket guide rollers 25 and the outside basket rollers 24. Then, the strip 8 is turned around the lead drum 19 toward a plurality of inside basket guide rollers 23 and enters into an annular space which is defined between the inside basket guide rollers 23 and the inside basket rollers 17. Thereupon, the strip 8 is transferred to the spiral guide rollers 16 and is fed into a pipe mill B at a speed which is set by the pair of measuring rollers 14. As a controller (not shown) which is adequately programmed in advance senses a situation wherein the unit coil of strip 8 is almost depleted, the controller starts to drive the motor 22 thereby to implement a preliminary storing procedure for the strip 8. According to this, as shown in FIGS. 3*b* and 4, in a state wherein the pair of measuring rollers 14 perceive a feeding speed which is requested by the pipe mill B, the pair of pinch rollers 11 are rotated at a speed which is faster than a preset speed of the pair of measuring rollers 14 thereby to input the strip 8 into the rotary looper. At this time, due to the fact that the rotary drum 18 is rotated in a counterclockwise direction by the driving of the motor 22 at a speed which corresponds to the difference between the speed of the pinch rollers 11 and the speed of the measuring rollers 14, the strip 8 which is taken out from the uncoiler A at the faster speed, is accumulated or stored on outside surfaces of the plurality of outside basket rollers 24 thereby to define outer convolutions of the strip 8. At the same time, the strip 8 is also accumulated or stored on outside surfaces of the inside basket rollers 17 through the lead drum 19 thereby to define inner convolutions of the strip 8. The strip 8 which is transferred from the inner convolutions to the spiral guide rollers 16, is continuously fed into the pipe mill B. The outer convolutions which are accumulated on the outside surfaces of the plurality of outside basket rollers 24, are transferred to the inner convolutions of the strip 8, starting from an inward portion thereof, while being led by the lead drum 19. The rotary drum 18 continues to rotate until a trailing edge of the currently depleted unit coil of strip 8 is exposed to the outside between the uncoiler A and the pair of pinch rollers 11. If the trailing edge of the strip 8 is exposed to the outside at a preset point between the uncoiler A and the pair of pinch rollers 11, the operation of the pair of pinch rollers 11 is stopped by the controller and thereby the trailing edge of the strip 8 is not moved any more. At this time, the motor 22 is reversely rotated thereby to rotate the rotary drum 18 in an opposite direction, that is, clockwise direction. By this, the inner convolutions are transferred to the spiral guide rollers 16 at a speed which corresponds to the speed of the strip 8 fed through the pair of measuring rollers 14 into the pipe mill B, starting from an inward portion thereof. The outer convolutions are gradually moved onto the inner convolutions which are accumulated on outside surfaces of the inside basket rollers 17, while being led by the lead drum 19, thereafter to be fed into the pipe mill B through the spiral guide rollers 16.

Figure 3A:
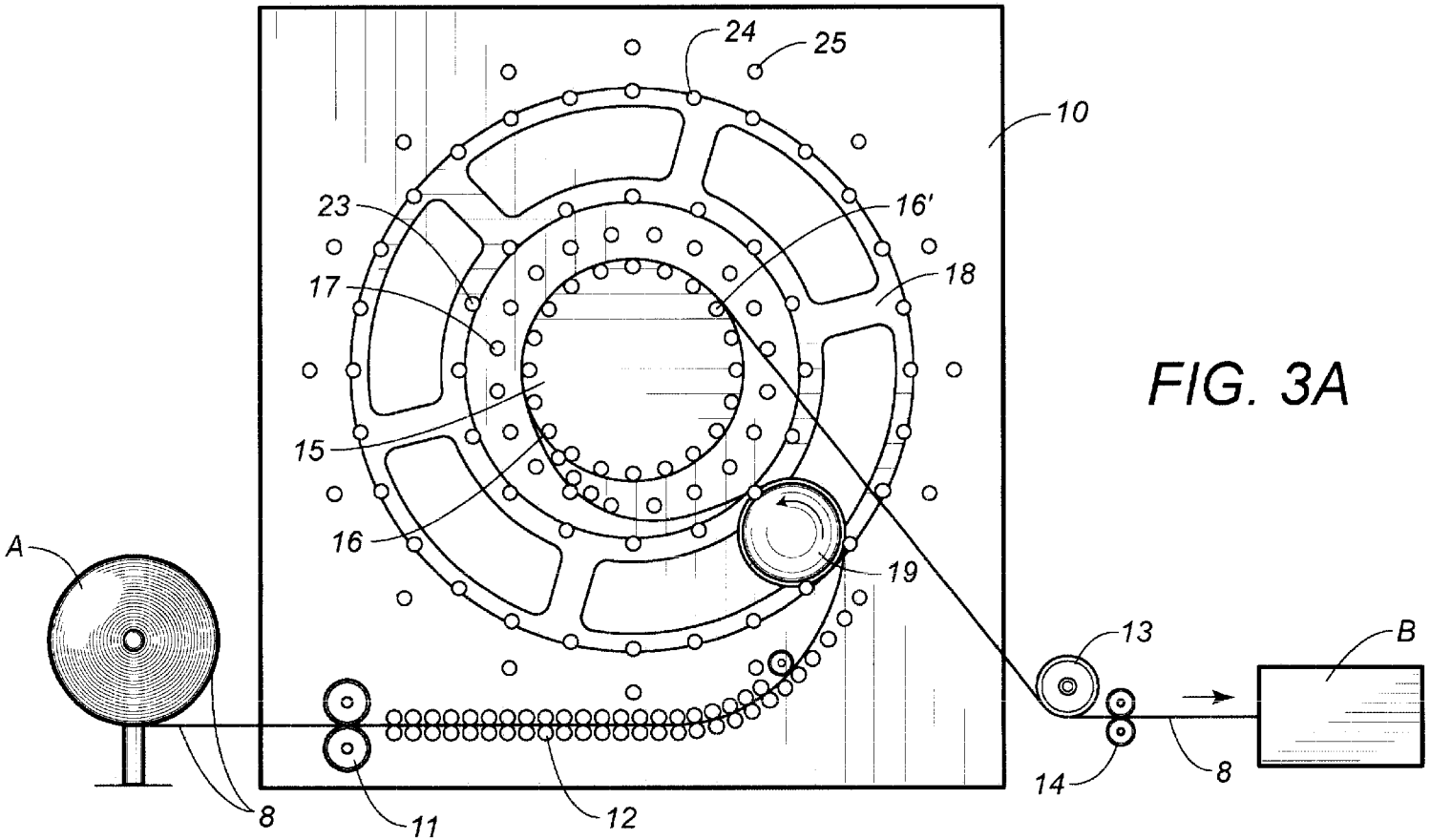
Figure 3B:
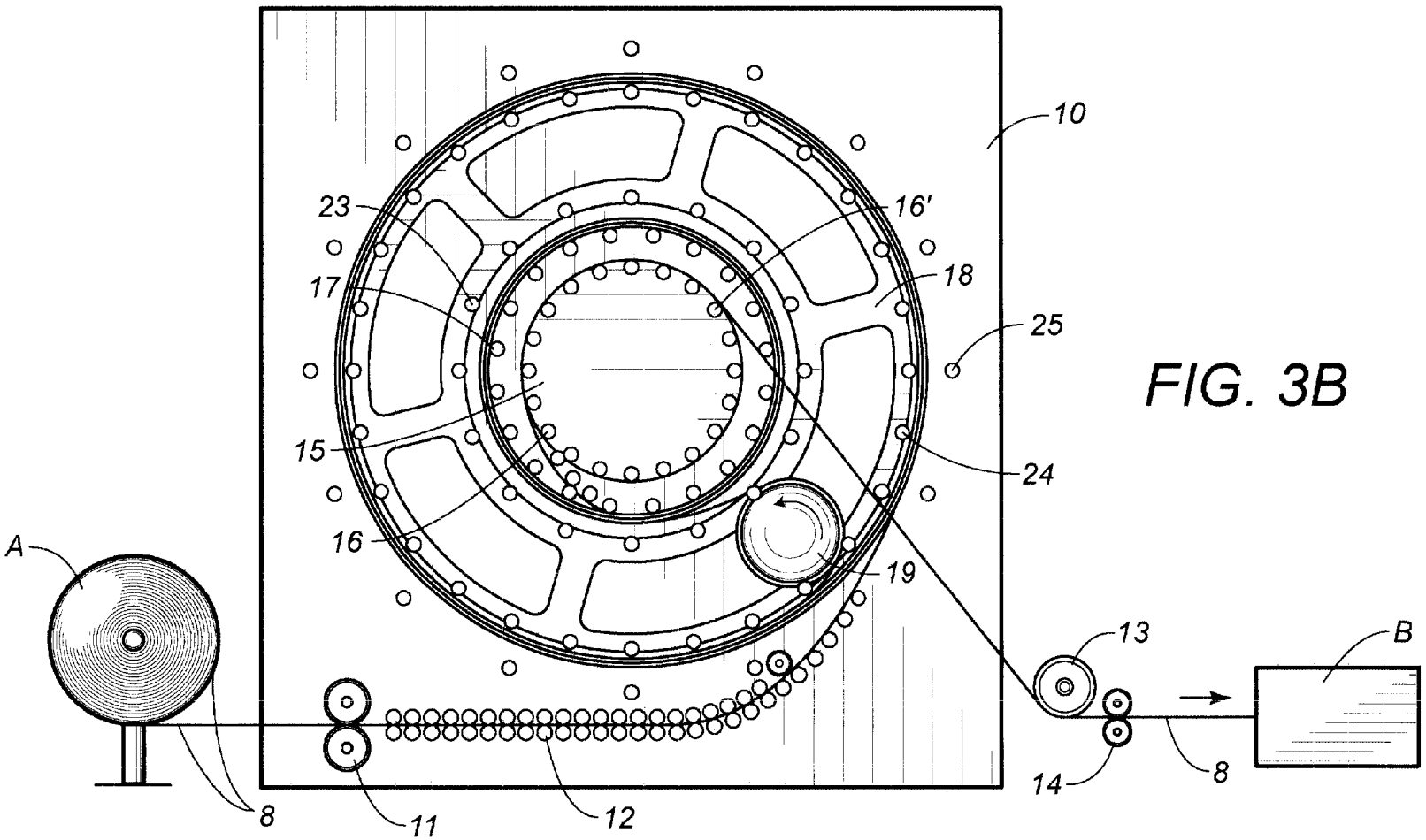
Figure 4:
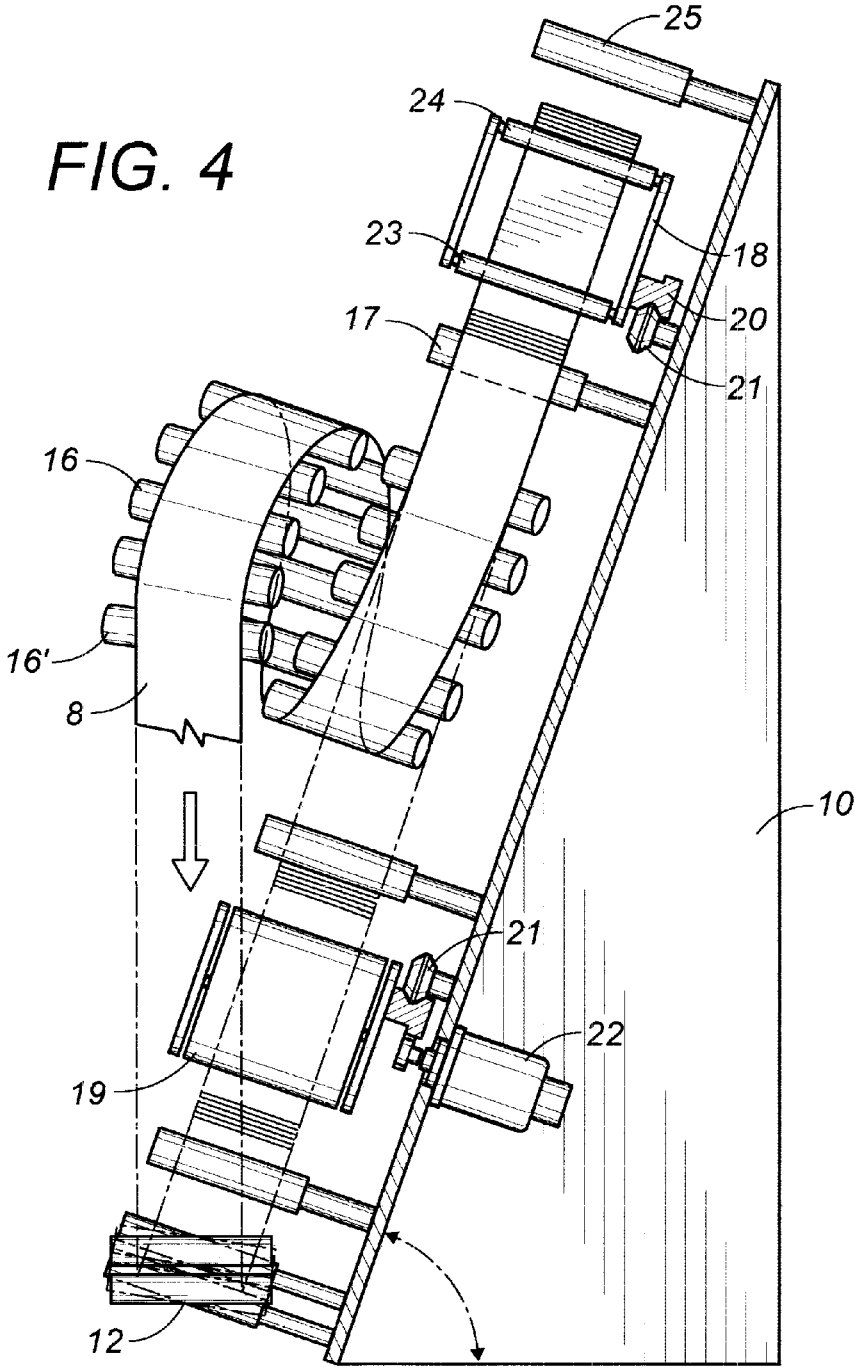
FIG. 4 is a schematic partial longitudinal cross-sectional view of the rotary looper of FIG. 3*b*.

At this time, while the outer and inner convolutions of the strip 8 which are preliminarily accumulated on the plurality of outside basket rollers 24 and the plurality of inside basket rollers 17, respectively, are supplied to the pipe mill B, by mounting a newly supplied unit coil of strip 8 on the uncoiler A and welding a leading edge of the newly supplied unit coil of strip 8 to the trailing edge of the currently depleted unit coil of strip 8 which is exposed to the outside between the uncoiler A and the pair of pinch rollers ll, the newly supplied unit coil of strip 8 is ready to be continuously taken out by the pair of pinch rollers 11. if all the outer and inner convolutions of the strip 8 are supplied to the pipe mill B, resulting in the state as shown in FIG. 3*a,* after sensing this situation, the controller ceases to drive the motor 22 and thereby the rotation of the rotary drum 18 is stopped. Thus, the newly supplied unit coil of strip 8 which is mounted on the uncoiler A, is continuously fed into the pipe mill B. By repeating the above-described processes, it is possible to continuously feed the strip 8 without interrupting the operation of the pipe mill B.

Meanwhile, the outer and inner convolutions of the strip 8 which are stored around the plurality of outside basket rollers 24 and the plurality of inside basket rollers 17, respectively, are willing to unwind outward by themselves, when the rotary drum 18 starts to rotate in the opposite clockwise direction. But the rotary drum 18 is rotated at a speed which is able to supply the same amount of the strip 8 as being pulled by the pair of measuring rollers 14, the convolutions of the strip 8 are prevented from unwinding outward by themselves and at the same time, are not likely to curl up toward their centers, respectively. At this time, while the convolutions of the strip 8 are maintained in a lax state, two adjoining convolutions are properly spaced apart from each other by a gap, and therefore, frictional contact between two adjoining convolutions is avoided. In other words, a momentary and spontaneous transfer of the strip 8 from the outer convolutions to the inner convolutions is repeatedly done due to the elasticity of the strip 8 itself. By this feature, the outer convolutions which are stored on the plurality of outside basket rollers 24, are repeatedly transferred to the inner convolutions which are stored on the plurality of inside basket rollers 17 while being led by the lead drum 19, whereby the preliminarily stored convolutions of the strip 8 can be smoothly and continuously fed into the pipe mill B without experiencing damage at all.

Furthermore, by the fact that the base member 10 has the predetermined slope ∠θ° with respect to the ground, the rotary drum 18 also functions with the same slope ∠θ° . Because a portion of load is applied onto the base member 10, stability is provided upon operation of the rotary looper, and vibration of the rotary looper is alleviated. In addition, since the load is dispersed in a vertical direction and a horizontal direction, it is helpful to prevent a variety of components from being worn out and broken due to concentrated load. In particular, as shown in FIG. 4, it is also helpful to offset a positional variation of the strip 8 due to the projecting contour of the plurality of spiral guide rollers 16, by the presence of the slope ∠θ° . Hence, an inputting position and a discharging position of the strip 8 are in line with each other. That is to say, the pair of pinch rollers 11, the final roller of the plurality of spiral guide rollers 16', and the pair of measuring rollers 14 are in line with each other, parallel to the plane of the base member 10, whereby the rotary looper can be applied to the existing pipe producing line as it is.

Moreover, it is profitable to drive the rotary looper for it can be run with reduced power. The thickness and width of the strip 8 are decided depending upon a use and a size of a pipe which is to be produced. In these cases, because weight of the strip 8 is substantial, in a state wherein the base member 10 is installed to have the slope ∠θ° as described above, elastic force and weight excessively act on the outer convolutions which are preliminarily stored between the outside basket guide rollers 25 and the outside basket rollers 24 and the inner convolutions which are preliminarily stored between the inside basket guide rollers 23 and the inside basket rollers 17. According to this, load can be overly applied to the motor 22, whereby the likelihood of the motor 22 and other components to be damaged is increased. Therefore, in this case, by horizontally installing the base member 10, the entire weight of the strip 8 acts on the base member 10, and thereby it is possible to drive the rotary looper with reduced power.

However, in this case, the rotary looper necessitates a wider installation space.

As a result, the rotary looper according to the present invention, constructed as mentioned above, provides advantages because it provides sufficient time for attaching, as by welding, a leading edge of a newly supplied unit strip to a trailing edge of a currently depleted unit strip, since a strip is continuously supplied to a pipe mill at a constant rate and predetermined convolutions of the strip are preliminarily stored. So, a pipe can be continuously produced without interrupting a continuous operation of the pipe mill, whereby the creation of inferior pipes can be minimized and a great deal of effort and time can be saved. Furthermore, it is possible to provide more pleasant working circumstances because a construction and operations of the rotary looper are simplified, and noise generation is lessened.

In the drawings and specification, there have been disclosed typical preferred embodiments of the invention and, although specific terms are employed, they are used in a generic and descriptive sense only and not for purposes of limitation, the scope of the invention being set forth in the following claims.

I claim:

1. A rotary looper apparatus comprising:

a base member having an input side and a discharge side;

a fixed drum installed on said base member and having a plurality of spiral guide rollers;

a pair of pinch rollers and a series of lead rollers sequentially disposed at said input side of said base member;

a pair of measuring rollers disposed at said discharge side of said base member;

a plurality of inside basket rollers circularly arranged along a circumferential outer surface of said fixed drum;

a lead drum rotatably disposed at a side of said fixed drum;

a plurality of outside basket guide rollers circularly positioned on said base member such that said plurality of outside basket guide rollers are spaced apart from said fixed drum by a predetermined distance, said base member being vertically oriented;

a rotary drum disposed around said fixed drum;

a motor means for rotatably driving said rotary drum via a rail which is wound around a plurality of rail rollers circularly installed on said base member;

a plurality of inside basket guide rollers circularly disposed along a circumferential inner surface of said rotary drum; and a plurality of outside basket rollers circularly disposed along a circumferential outer surface of said rotary drum, said base member having a slanting surface, said pair of pinch rollers and a roller of said plurality of spiral guide rollers and said pair of measuring rollers being aligned with each other along a line parallel to said slanting surface of said base member.

* * * * *